US011825899B2

(12) United States Patent
Michaels

(10) Patent No.: US 11,825,899 B2
(45) Date of Patent: Nov. 28, 2023

(54) ADJUSTABLE BRIM FOR A HAT

(71) Applicant: Brigid Michaels, Palatka, FL (US)

(72) Inventor: Brigid Michaels, Palatka, FL (US)

( * ) Notice: Subject to any disclaimer, the term of this patent is extended or adjusted under 35 U.S.C. 154(b) by 0 days.

(21) Appl. No.: 17/943,967

(22) Filed: Sep. 13, 2022

(65) Prior Publication Data

US 2023/0000193 A1 Jan. 5, 2023

Related U.S. Application Data

(63) Continuation-in-part of application No. 17/691,892, filed on Mar. 10, 2022, now abandoned, which is a continuation of application No. 17/181,726, filed on Feb. 22, 2021, now abandoned.

(60) Provisional application No. 62/979,494, filed on Feb. 21, 2020.

(51) Int. Cl.

| | |
|---|---|
| ***A42B 1/22*** | (2006.01) |
| ***A42B 1/018*** | (2021.01) |
| ***A42B 1/002*** | (2021.01) |
| ***A42B 1/0186*** | (2021.01) |

(52) U.S. Cl.

CPC ..... *A42B 1/22* (2013.01); *A42B 1/002* (2013.01); *A42B 1/018* (2021.01); *A42B 1/0186* (2021.01)

(58) Field of Classification Search

CPC ..... A42B 1/002; A42B 1/0186; A42B 1/0181; A42B 1/018; A42B 1/0182; A42B 1/0184; A42B 1/0187; A42B 1/0188; A42B 1/041; A42B 1/045; A42B 1/18; A42B 5/00; A42B 1/22; A42B 1/201

USPC ..... 2/171, 184.5, 204, 207, 209.11, 209.12, 2/209.13, 209.3, 209.4, 175.6, 175.7, 172, 2/195.1, 10

See application file for complete search history.

(56) References Cited

U.S. PATENT DOCUMENTS

| | | | | |
|---|---|---|---|---|
| 5,083,317 | A * | 1/1992 | DeMoreta | A42B 1/0187 2/12 |
| 5,323,491 | A * | 6/1994 | Barrett, Jr. | A42B 1/0187 2/172 |
| 5,488,740 | A * | 2/1996 | Garza | A42B 1/22 2/195.3 |
| 5,694,647 | A * | 12/1997 | Crickmore | A42B 1/0187 2/172 |
| 5,862,520 | A * | 1/1999 | Wyant | A42B 1/0182 2/10 |
| 6,260,208 | B1 * | 7/2001 | Wang | A42B 1/0182 2/171.03 |
| 6,484,323 | B1 * | 11/2002 | Pu | A42B 1/24 2/171.1 |
| D672,096 | S * | 12/2012 | Bryan | A42B 1/006 D29/122 |
| 9,149,085 | B2 * | 10/2015 | Bryan | A42B 3/0406 |
| 10,194,709 | B1 * | 2/2019 | Jones | A42B 1/0186 |

(Continued)

*Primary Examiner* — Jameson D Collier
(74) *Attorney, Agent, or Firm* — K&L Gates LLP

(57) ABSTRACT

An adjustable brim for use with a hat, such as a baseball-style hat includes a sheath having a rounded shape for positioning around the hat and including a channel, a body, a tightening device positioned within the channel of the sheath, and a fastener positioned on the tightening device for adjusting the size of the sheath. The body includes an inner edge, an outer edge opposite the inner edge, an outer surface, and an inner surface opposite the outer surface, and the inner edge of the body is connected to the sheath.

13 Claims, 11 Drawing Sheets

(56) References Cited

U.S. PATENT DOCUMENTS

| | | | | |
|---|---|---|---|---|
| 2006/0212995 | A1* | 9/2006 | Collins | A42B 1/0186 2/175.6 |
| 2006/0253957 | A1* | 11/2006 | Orozco | A42B 3/105 2/171 |
| 2008/0066216 | A1* | 3/2008 | Yun | A42B 1/0187 2/172 |
| 2012/0167284 | A1* | 7/2012 | Yeung | A42B 1/08 2/455 |
| 2013/0074244 | A1* | 3/2013 | Cole | A42B 1/0187 2/172 |
| 2013/0174321 | A1* | 7/2013 | Bundy | A42B 1/006 2/173.5 |
| 2014/0310853 | A1* | 10/2014 | Miles | A42B 1/0187 2/172 |
| 2016/0113344 | A1* | 4/2016 | Martin | A42B 1/0187 2/455 |
| 2017/0055618 | A1* | 3/2017 | Fulper | A42B 1/22 |
| 2017/0079360 | A1* | 3/2017 | Sharrad | A42B 1/048 |
| 2018/0027911 | A1* | 2/2018 | Weiler | A42B 1/0182 |
| 2020/0113264 | A1* | 4/2020 | Fujisaka | A42B 1/18 |
| 2021/0100307 | A1* | 4/2021 | Sunseri | A42B 1/0186 |

* cited by examiner

ADJUSTABLE BRIM FOR A HAT

CROSS-REFERENCE TO RELATED APPLICATIONS

This application comprises a continuation-in-part application of U.S. application Ser. No. 17/691,892 filed Mar. 10, 2022, which is a continuation application of U.S. application Ser. No. 17/181,726 filed Feb. 22, 2021, which claims the benefit of priority to U.S. Provisional Application No. 62/979,494 filed on Feb. 21, 2020, the disclosures of which are incorporated herein by reference.

BACKGROUND OF THE INVENTION

The present subject matter relates generally to a hat brim that covers the neck and ears of the user. More specifically, the present subject matter provides a cloth hat brim that sits atop the head of the user, facing to the back of the user, using an adjustable band that wraps around the front of a hat which has a forward-facing visor, such as the basic style known as a baseball cap, or other suitable hats.

The number one risk for skin cancer is sun exposure. The most recent statistics provided by the American Cancer Society®, the 2022 Cancer Facts and Figures, show that the number of new invasive melanoma cases diagnosed annually increased by 31% in the past decade (2012-2022). Studies have shown that 86% of melanomas can be attributed to exposure to ultraviolet (UV) radiation from the sun. While exposure may start with a single event, the greater concern is for a long term exposure that elevates the risk. Spending time in the sun creates an ever-present adverse risk that must be addressed. The best way to help avoid this risk is to completely cover or shade the skin from the sun's UV rays.

There are many choices of hats of various design to shield the eyes, ears, face, and neck of the wearer. A baseball-style cap is preferred by many, because of its excellent ability to shade the scalp and the eyes from the sun, and it is portable and tight-fitting on the user's head. But the problem with a baseball-style cap is that it lacks a brim on the sides and back and does not adequately protect the ears and neck from the sun. For cap wearers, the solutions that are currently available are adding flaps, drops, and drapes which are often unbecoming and ineffective. These solutions also do not allow for distance or air movement above the ears and neck. They also easily lift away from the wearer with wind so the shade is often lost. When moving fast as in a power boat, these solutions vibrate, ruffle, and slap the face and neck of the wearer. Further, these solutions are typically of a single thin layer of material which does not block UV effectively, and they are typically hot and block air flow.

A common problem faced by users wearing hats and other headgear is that hats and headgear often do not fit the user's head perfectly well. For example, some people have smaller or larger than average sized heads such that conventional hat sizes are too big or small, respectively. Also anyone who has lost a hat knows without a chinstrap in a wind or a fast moving situation the risk of loss often means removing the hat to keep a hold of it hence, even more sun exposure.

Accordingly, a need exists for an adjustable brim which can be placed onto the head over a baseball-style cap that shields the ears and neck of the user while providing airflow thereto and that can be manipulated into different positions relative to the user's ears and neck, as described herein.

BRIEF SUMMARY OF THE INVENTION

To meet the needs described above, the present application provides an adjustable brim that attaches to a baseball-style cap to provide additional shading around the user's neck and ears while allowing for airflow thereto. The adjustable brim provided herein includes a sheath that rests around the cap and a body that extends outwardly from the sheath to provide shade to the user's neck and ears. A tightening device such as a cord threaded through the sheath and a fastener on the tightening device enable the user to adjust the size of the sheath to fit securely about the hat.

In one embodiment, the sheath includes a first portion or length onto which the brim body is attached and a second portion or length that is free from the body. During use, the second portion of the sheath is positioned atop the forward brim or visor of the baseball cap, and the brim body of the adjustable brim extends along the sides and back of the baseball cap. In some embodiments, the brim body and the sheath are sewn or otherwise secured together. In other embodiments, the body and the sheath are formed integrally.

The adjustable brim includes a loop or other connection mechanism at a location opposite the second portion of the sheath. While the second portion of the sheath rests atop the baseball cap brim, the loop may engage the back strap closure of the baseball cap brim visor so that the adjustable brim of the present application is secured to the user's baseball cap.

The adjustable brim may also include a pair of loops along the opposing sides of the sheath for receiving ends of a chin strap. In one embodiment, the chin strap extends below the user's chin and includes beads at opposite ends thereof that hold the ends of the chin strap in each loop. The chin strap may include a chin strap fastener at a midpoint along its length which enables the user to adjust the tightness of the chin strap against the chin. In other embodiments, the ends of the chin strap connect to the adjustable brim through snaps, Velcro®, a type of hook-and-loop fastener, or other securement means.

In some embodiments, the cloth brim is pliable, such that it can be bent, folded, or rolled into a smaller size for portability. Once rolled, the tightening device can be wrapped or looped around the body of the brim and secured by the fastener. If preferred, a further fastener, such as a carabiner type fastener, or any method of attachment may be used to attach to the portable brim to a pant loop, bag, or key chain for hands-free transport of the brim while it is not in use. This portability allows for a high frequency of use. Sun exposure for even short time periods such as walking through parking lots adds up significantly when done repeatedly on a daily basis over a lifetime, and portability increases the likelihood that a user would wear the adjustable brim, reducing UV exposure over time. Further, the adjustable brim of the present application is compatible with a variety of headwear designs and styles.

In a preferred embodiment, a brim for use with a baseball-style hat includes a sheath having a rounded shape for positioning around the hat and including a channel, a body, a tightening device, and a fastener. The body includes an inner edge, an outer edge opposite the inner edge, an outer surface, and an inner surface opposite the outer surface. The inner edge of the body is connected to an attachment edge of the sheath. The tightening device is positioned within the channel of the sheath, and the fastener is positioned on the tightening device for adjusting the size of the sheath. The sheath of the adjustable brim includes an opening through which a portion of the tightening device extends. The fastener is secured to the portion extending through the opening.

Additionally, in a preferred embodiment, the brim is constructed so that the brim body can be manipulated between a downward position and an upward position, in part or in whole, and retain its positioning, while the user is wearing the adjustable brim. As such, the user can selectively manipulate the brim body such that an outer portion of the body's inner surface faces outwardly, an outer portion of the body's outer surface faces inwardly toward the sheath, and the user's ear(s) and/or neck are selectively covered and uncovered.

In some embodiments, one or more loops are positioned on the inner surface of the body. In other embodiments, the sheath of the adjustable brim is integral with brim. The adjustable brim further comprising a chin strap, wherein the one or more loops includes a first and second chin strap loops for receiving first and second ends of the chin strap.

Additional objects, advantages, and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one implementation in accord with the present concept, by way of example only, not by way of limitations. In the figures, like reference numerals refer to the same or similar elements.

DETAILED DESCRIPTION OF THE DRAWINGS

Figure 1:
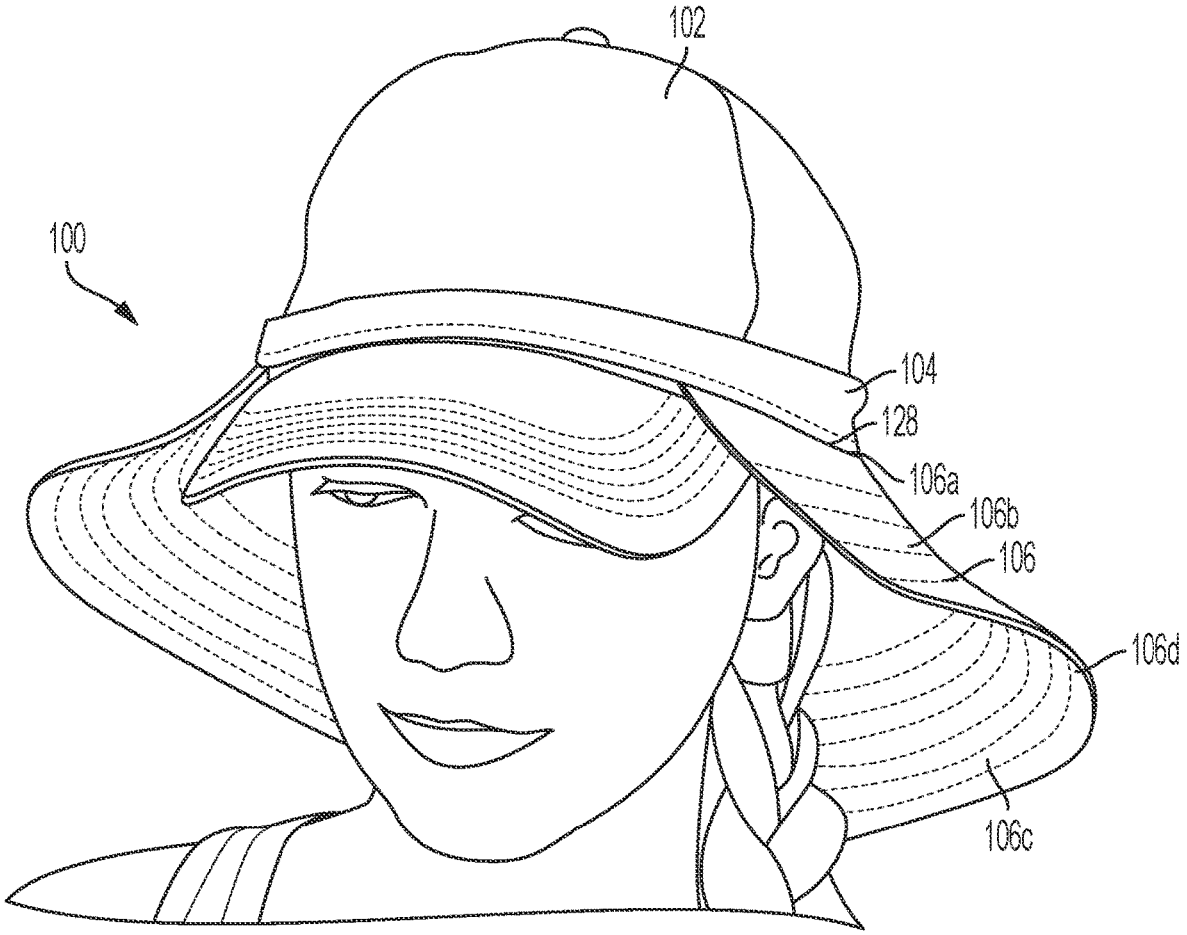
FIG. 1 is a front isometric view of an adjustable brim of the present application positioned on a hat worn by a user and deployed in a uniform perfectly centered (on face & cap visor) in a fully downward position.

FIGS. 1-13 illustrate an embodiment of an adjustable brim 100 for a baseball-style cap 102 (FIGS. 1, 2A, 2B, and 10). The adjustable cloth brim 100 includes a sheath 104 that rests around the cap 102 and a brim body 106 extending outwardly from the sheath 104 to provide shade to the user's neck and ears. The adjustable brim 100 provides shade to the user's neck and ears while the front brim of the cap 102 provides shade to the user's face. A tightening device 110 (FIG. 8) threaded through the sheath 104 and a fastener 112 (FIG. 8) on the tightening device 110 enable the user to adjust the size of the sheath 104 to fit securely about the hat. In the embodiments illustrated herein, the adjustable brim 100 is positioned atop a baseball cap 102; in other embodiments, the adjustable brim 100 is connected to the baseball cap 102.

Figure 2A:
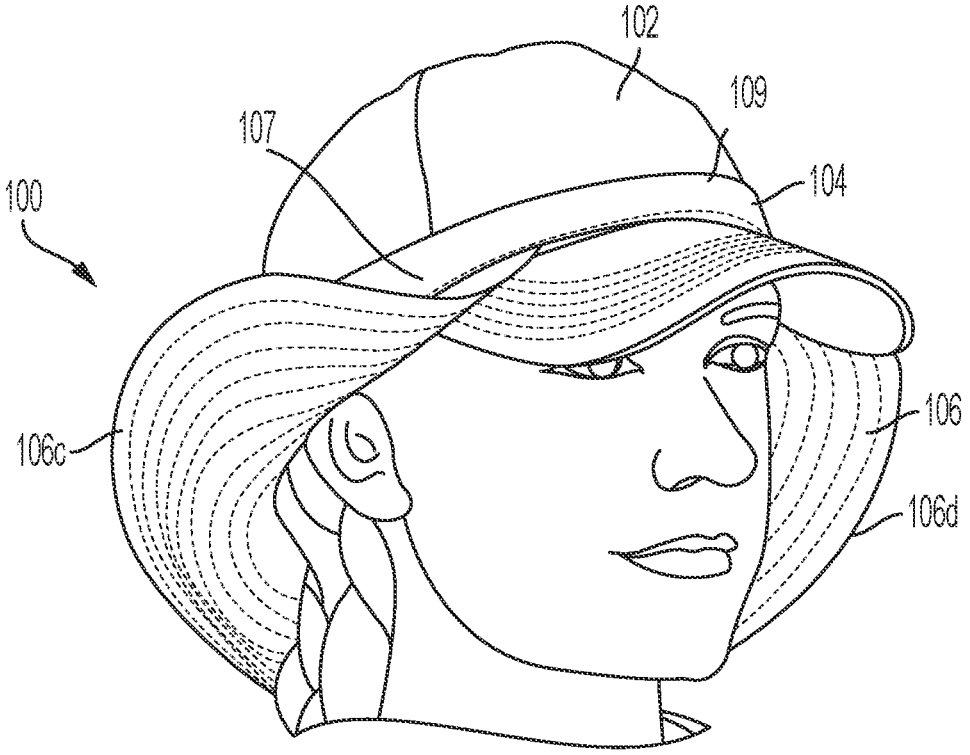
FIGS. 2A and 2B are a front isometric view and a rear isometric view of the adjustable brim of FIG. 1 with a portion of the brim body manipulated into an upward position with the adjustable brim deployed in a uniform perfectly centered (on face & cap visor) in a partially high upward and partially low downward position.
Figure 2B:
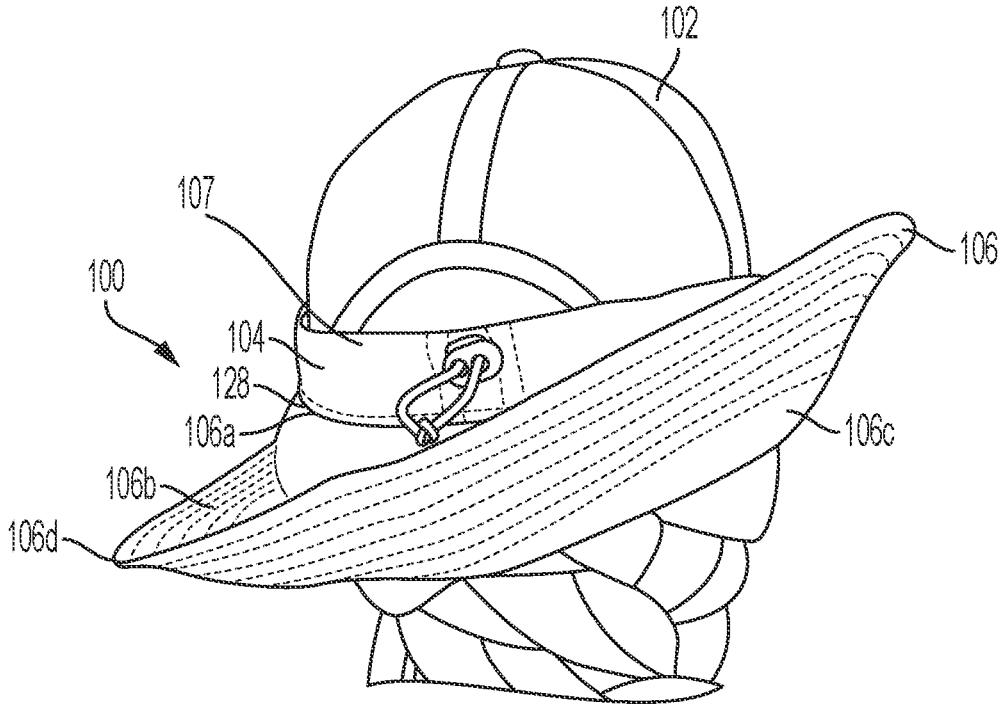
Figure 3:
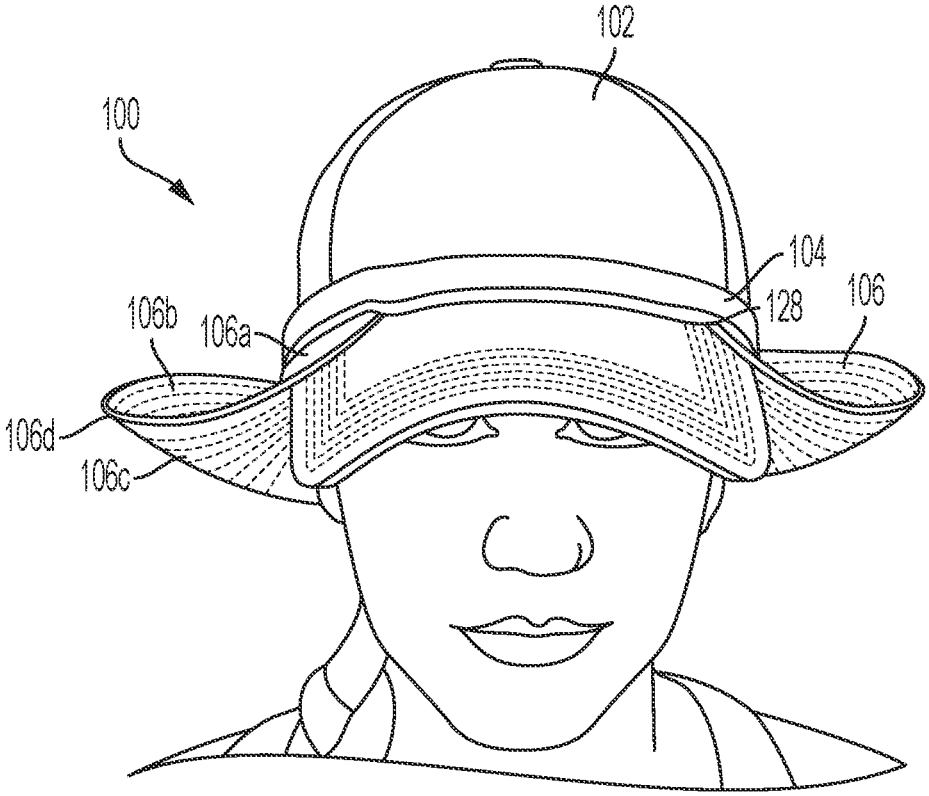
FIG. 3 is a front isometric view of the adjustable brim of FIG. 1 with the full length of the brim body manipulated into an upward position with the adjustable brim deployed in a uniform perfectly centered (on face & cap visor) in a medium or mid position all around.

As shown in FIGS. 1-3, the brim body 106 extends outwardly and downwardly from the sheath 104 in various configurations. As seen in FIG. 1, in one configuration, the brim body 106 extends such that it has an outward and downward body angle that allows airflow to the neck and ears of the user. More specifically, in this configuration, the body's inner surface 106*c* faces the user's ears and/or neck but is maintained in a position distanced therefrom. Additionally, as seen in FIG. 2A, the body 106 is constructed (further detailed below) such that the user can selectively manipulate a portion or all of the body 106 as to achieve a different positioning of the brim body 106. In this configuration, the body's inner surface 106*c* partially faces outwardly away from the user's neck and ears and the body's outer surface 106*b* partially faces inwardly toward the sheath 104 so as to expose the user's ears and/or neck. FIG. 2B shows the same configuration from the rear. This view illustrates the body's inner surface 106*c* facing the exterior, while the body's outer surface 106*b* is parallel with the sheath 104 so as to face the sheath 104. While only a portion of the brim body 106 is manipulated into an upward position in FIGS. 2A and 2B, the entire length of the brim body 106 is manipulated into an upward position in FIG. 3.

Referring to FIG. 1, an inner edge 106*a* of the body 106 attaches to an attachment edge 128 of the sheath 104, allowing the body 106 to project downwardly and outwardly from the sheath 104. In order to position the body 106, specifically an outer edge 106*d* thereof, maintained at a lofted position spaced from the user's ears and neck, the inner edge 106*a* of the body has a different curvature than a curvature of the attachment edge 128 of the sheath 104 such that the connection of the different curved edges causes tensioning of the brim body 106 into a first outward and downward position shown in FIG. 1. The outer edge 106*d* of the body 106 also has a different curvature than the curvature of the attachment edge 128 of the sheath.

Figure 4:
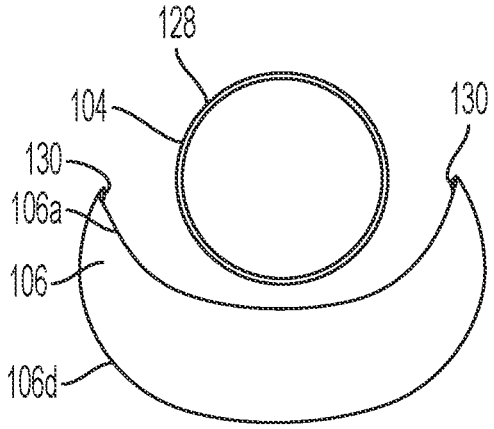
FIG. 4 is a plan view of the sheath and the brim body of the adjustable brim of FIG. 1.
Figure 6A:
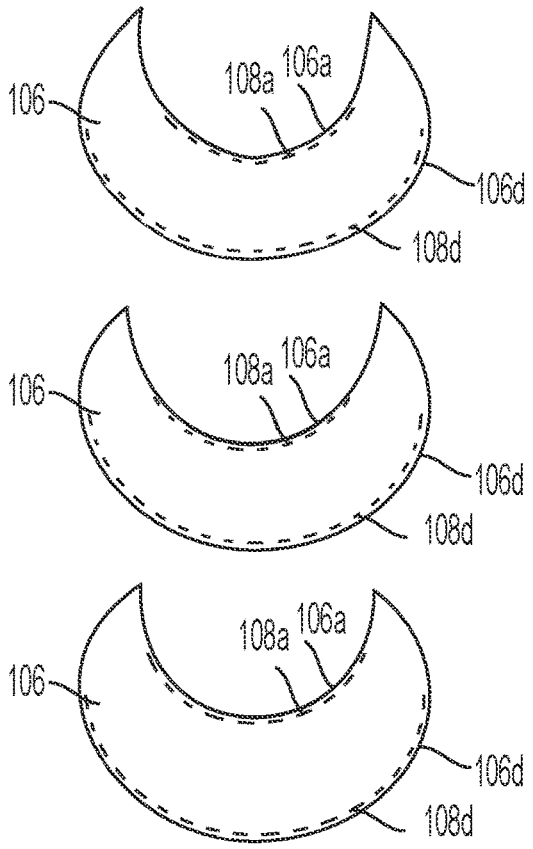
FIG. 6A illustrates various possible shapes of brim bodies for use in the adjustable brim of FIG. 1.
Figure 6B:
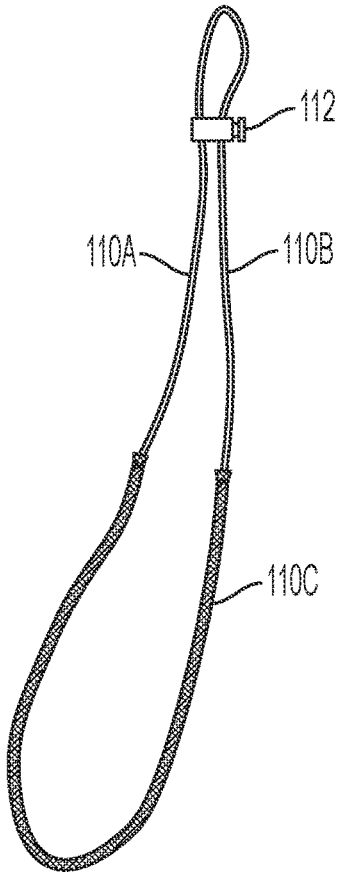
FIG. 6B illustrates an example tightening device of the adjustable brim of FIG. 1.

More specifically, as seen in FIGS. 4 and 6A, each of the inner edge 106*a* and the outer edge 106*d* of the body 106 has a parabolic shape portion 108*a*. 108*d*, respectively, when the body 106 is positioned along a planar surface. In contrast, the sheath 104 has an approximately circular shape when positioned along a planar surface. In turn, an attachment edge 128 of the sheath 104 has a circular curvature that does not match the parabolic shapes of the inner and outer edges 106*a*, 106*d*, seen best in FIG. 4.

The structure created by the parabolic curves of the inner and outer edges 106*a*, 106*d* and the inner edge 106*a* meeting on the sheath 104 is analogous to a flying buttress in architecture with a "flyer" or sloping beam supporting an outward load. With the adjustable brim 100 of the present application, the brim edge 106*a* joining the sheath 104 corresponds to the flyer, and rather than support by buttressing, the brim body 106 extends downwardly and outwardly into a lofted position and carries the weight of the fabric construction outwardly around the circumference of the brim, maintaining a certain amount of circumferential tension. By positioning on a cap in the sweatband region at or about where the brim-visor projects forward, the tension is transmitted through the sheath 104 around the forehead to form a complete circular structure supporting the lofted sideward-, backward-, and outward-extending brim body 106.

In still further embodiments, the inner and outer edges 106*a*, 106*d* may have non-parabolic curved shapes that are different from the generally circular shape of the attachment edge 128 of the sheath 104 such that connection of the inner edge 106*a* to the attachment edge 128 causes tensioning of the brim body 106.

Figure 5:
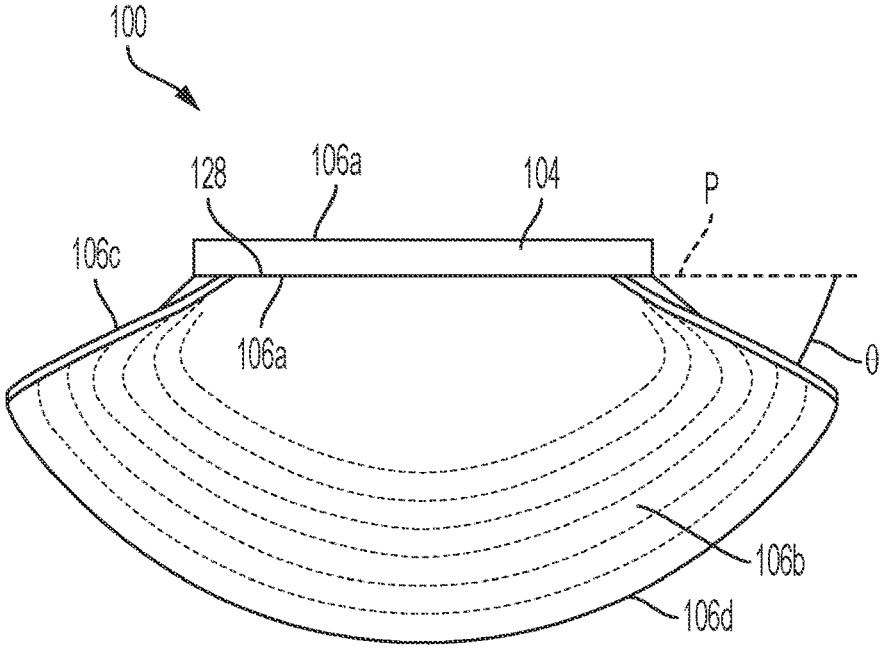
FIG. 5 is a front elevational view of the adjustable brim of FIG. 1

As shown in FIG. 5, the brim body 106 attaches to the sheath 104 such that the inner edge 106*a* and the attachment edge 128 are coupled along the plane P, and the curvature of the inner edge 106*a* of the body 106 conforms to match the approximately circular shape of the attachment edge 128 of the sheath 104, which causes the inner and outer surfaces 106*b*, 106*c* of the body to become tensioned out of the plane P. This tensioning positions the outer edge 106*d* below the attachment edge 128 and corresponding plane P, yet supports the outer edge 106*d* in a lofted position spaced from the user's neck and ears, forming a truncated cone shape and allowing airflow between the user's neck and the brim body 106 as shown in FIG. 1. As shown in FIG. 5, the outer edge 106*d* is positioned such that the inner and outer surfaces of the brim body 106 form an angle with the plane P of between 55 and 65 degrees.

This tensioning created by the parabolic shapes of the inner and outer edges 106*a*, 106*d* allows for a fluidity of various brim shapes within the range of angles relative to the plane P. This fluidity of shapes can form stable contour variations as described and illustrated herein. In the embodiments illustrated in FIGS. 4 and 6, the parabolic shapes of the inner and outer edges 106*a*, 106*d* meet at first and second endpoints 130, to define a crescent-like shape of the body 106. The parabolic curvature can vary, as shown in the alternative embodiments illustrated in FIG. 4. Specifically, the shape of the outer edge 106*d* may vary to provide different sizes of the body 106, ranging from short to long, of the adjustable brim 100 conforming to the functional needs of the user to effectively make a wider brimmed hat. Additionally, instead of a full 360 degrees of brim offered by conventional brims, the adjustable brim of the present application has an approximately 270 degree span. Conventional brims spanning the full 360 degrees are generally difficult to hold shape and do not allow for adjustability between varying brim shapes.

The inner edge 106*a* may connect to the attachment edge 128 through stitching, sewing, or any other suitable means.

Further, the brim body 106 is constructed so that it is sufficiently rigid to hold its shape, but also pliable enough to be configurable by the user to be manipulated and positioned to adjust the location of the shading, as seen in FIGS. 2A, 2B, and 3. The parabolic shapes of the inner and outer edges 106*a*, 106*d* of the brim body 106 combined with the conforming of the parabolic shapes to a circular curvature of the attachment edge of the sheath 104 provide tensioning that enables the user to manipulate the outer edge 106*d* upwardly from the first downward position shown in FIG. 1 to a second upward position shown in FIG. 3. The adjustable brim of FIGS. 2A and 2B include a portion adjacent to the user's left ear in the downward position and a portion adjacent to the user's right ear in the upward position. The curved upward position of the brim 106 provides a lateral curvature between the inner and outer edges 106*a*, 106*d*, seen in FIG. 3. This lateral curvature may define an additional parabolic shape in some embodiments. In other embodiments, the lateral curvature may define a radius of curvature of approximately 0.25 in. In still further embodiments, the inner and outer surfaces 106*c*, 106*d* of the brim body 106 can be manipulated to allow a downward projection of 55 degrees from the plane P before curving upwardly towards the outer edge 106*d* with a radius of curvature of 1.25 in, forming a valley. The parabolic shapes of the inner and outer edges 106*a*, 106*d* of the brim body combined with the conforming of the parabolic shapes to a circular curvature of the attachment edge of the sheath 104 provide tensioning that enables the user to modify the shape of the brim during use, manipulating portions of or the entire length of the brim fluidly between various shapes and angles to provide various amounts of shade, airflow, and streamlined styles.

Further, the brim body 106 may be manipulated such that only a portion of the length of the brim 106 is manipulated into the second upward position. The brim 106 may also be manipulated so that two portions of the brim 106 are manipulated into the upward position while a third portion separating the two upward portions is positioned in the first downward position, or two portions are manipulated into the downward position while a third portion separating to the two downward portions is positioned upwardly. FIGS. 2A and 2B illustrate a first portion of the brim 106 in the upward position while a second portion of the brim 106 is in the downward position, and FIG. 3 illustrates the entire length of the brim 106 in the upward position. In comparison to hat shade devices having a drape or flap, such devices have no ability to be positioned upwardly but instead fall at angles sometimes exceeding a 90 degree angle and/or flapping uncomfortably in the wind against the user's neck and ears.

The brim body 106, or a portion thereof, may be configured to be manipulated or positioned upwardly along a line generally aligned with one of the inner edge or outer edge. In the positioning illustrated in FIGS. 2A and 2B, the user's right ear and neck may be exposed to sunlight and/or increased air flow in breezy conditions compared to the user's left ear and neck that remains protected by the downwardly positioned portion of the brim body 106.

In one embodiment, the brim body 106 includes a first layer of material for the inner surface 106*c* and a second layer of material for the outer surface 106*d*. In the illustrated embodiment, the first and second layers of material are sewn together along the inner and outer surfaces and also through a plurality of stitch lines. Each line of stitching is parallel to the outer edge, and the plurality of stitch lines spans the inner and outer edges to cover the surfaces thereof. Brim binding is another technique that could be combined with stitching around the brim to increase stiffness, holding the brim shape. It should be noted that additional factors, like stitching patterns and thread thicknesses used, can also play a factor in achieving the desired construction of the body 106. In alternate embodiments, the body 106 can include, for example, a middle layer (not shown here) that adds additional rigidity and/or pliability. Any suitable material may be used for the construction of the brim body 106.

The brim body 106 and the sheath 104 are sufficiently ductile and malleable in their ability to sustain a large, semi-permanent deformation under varying shape molding tensile and compressive manipulations. Ductility refers to the physical property of being pulled or molded into a new form and being able to be flexible, loose, and yielding as a result of being able to be stretched and shaped easily. Malleability is a measure of a material deformation under compressive stress. This ductility and malleability is key to the usable functionality in this invention. While fabrics are not considered brittle as with brim-visors, fabrics may kink, bend, and fold without malleability or ductility. Examples of fabric without malleability or ductility are drops, drapes and flaps. With a few calculated rows of stitching and a measured fabric construction including warp and weft orientations or combinations of material types, the adjustable brim 100 maximizes for ductility and malleability, enabling shapes that are both fashionable and have multifold functionality. Any suitable fabric material may be used.

Referring to FIG. 4, the body 106 has an arcuate shape with an inner edge 106*a* that, when attached to the sheath 104, extends along a portion 107 (see FIG. 7) of the attachment edge 128 of the sheath 104. The body 106 includes inner and outer surfaces 106*c*, 106*b* extending between the inner edge 106*a* and an outer edge 106*d* opposite thereof. In addition to the arcuate, crescent-like shape shown in the illustrated embodiment, the spatial relationship between the inner edge 106*a* and the outer edge 106*d* may form a shape that is oval, square, or any other shape that effectively covers the neck and ears of the user from an overhead perspective.

The sheath 104 has an approximately circular shape with an inner channel 105 that extends around the hat 102 of the user and is adjustable in size to fit about the cap 102. In the illustrated embodiment, the sheath 104 comprises a single panel of material including first and second edges 104*a*, 104*b* sewn together to form the channel 105. The inner edge 106*a* of the body 106 is sewn between at least a portion 107 of the first and second edges 104*a*, 104*b* of the sheath 104. In other embodiments, the sheath 104 may be formed integrally with the body 106 by attaching a portion of the inner edge 106*a* of the body 106 onto itself to form the channel 105. In still further embodiments, the sheath 104 may comprise two or more panels of material secured to the body 106. The sheath 104 may attached to the body 106 using a stitch or other suitable method.

Figure 7:
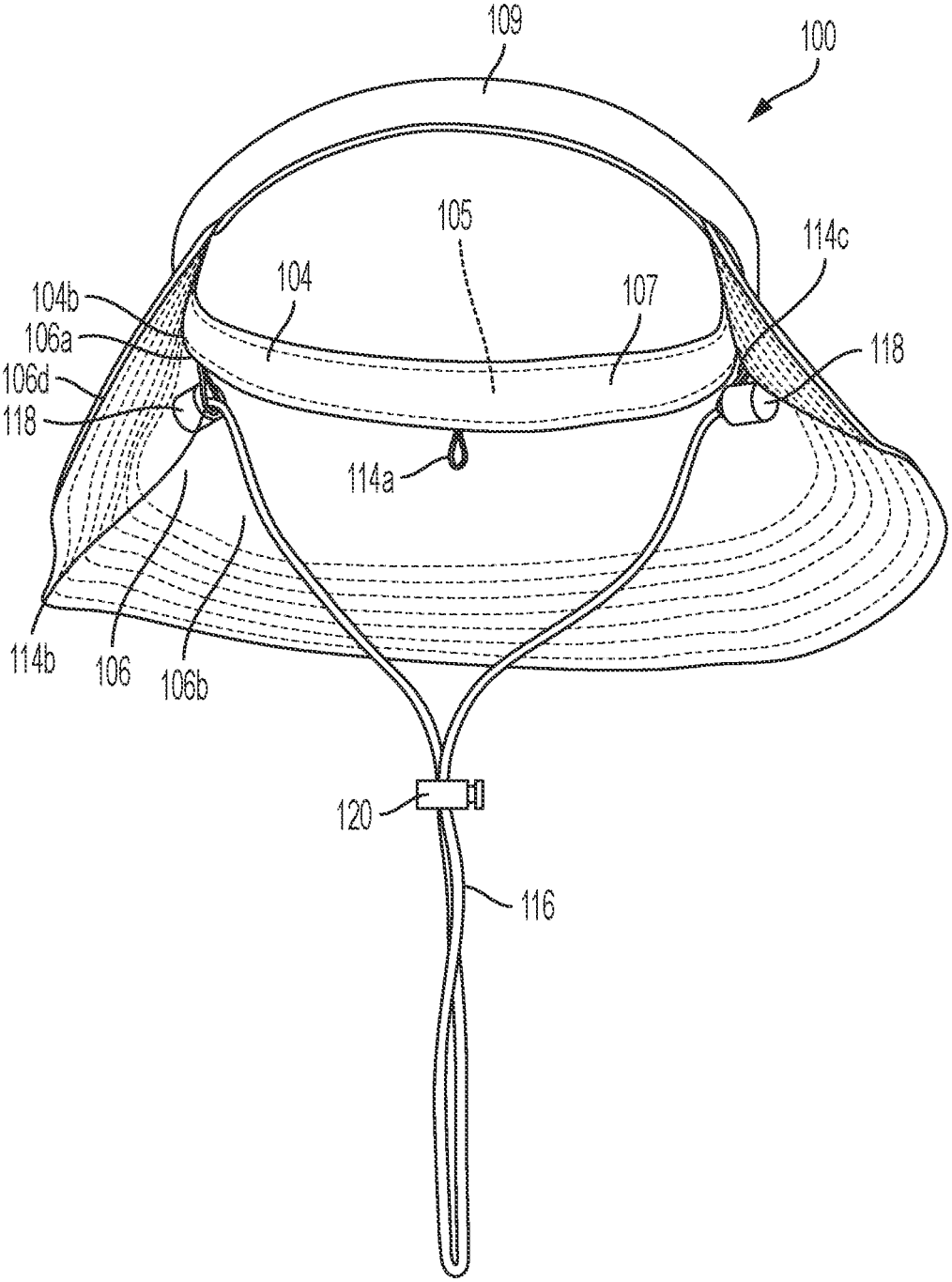
FIG. 7 is a front isometric view from below of the adjustable brim of FIG. 1 as a removed from the user and/or the baseball cap.
Figure 8:
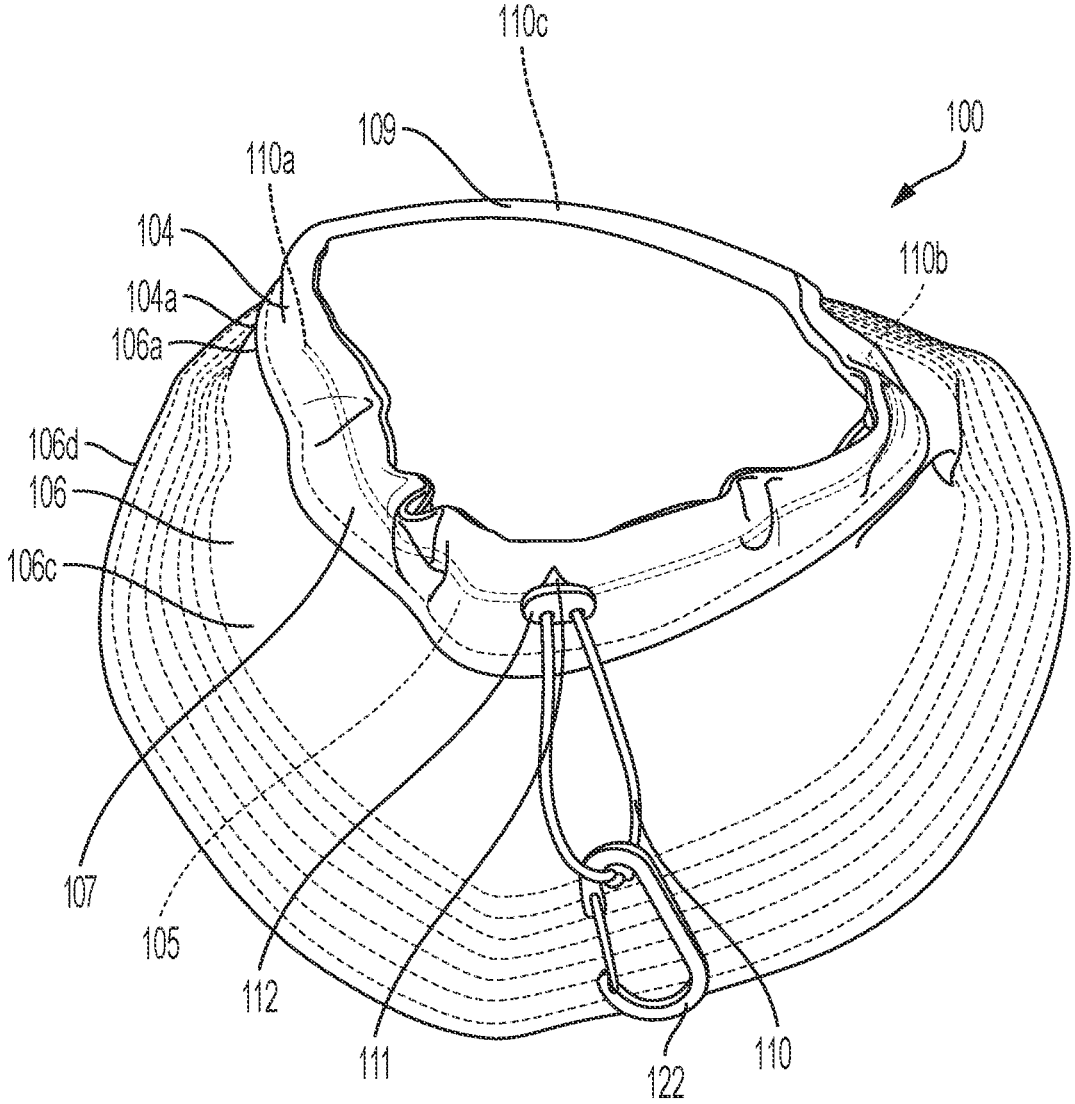
FIG. 8 is a rear isometric view from above of the adjustable brim of FIG. 1 as a removed from the user and/or the baseball cap.
Figure 9:
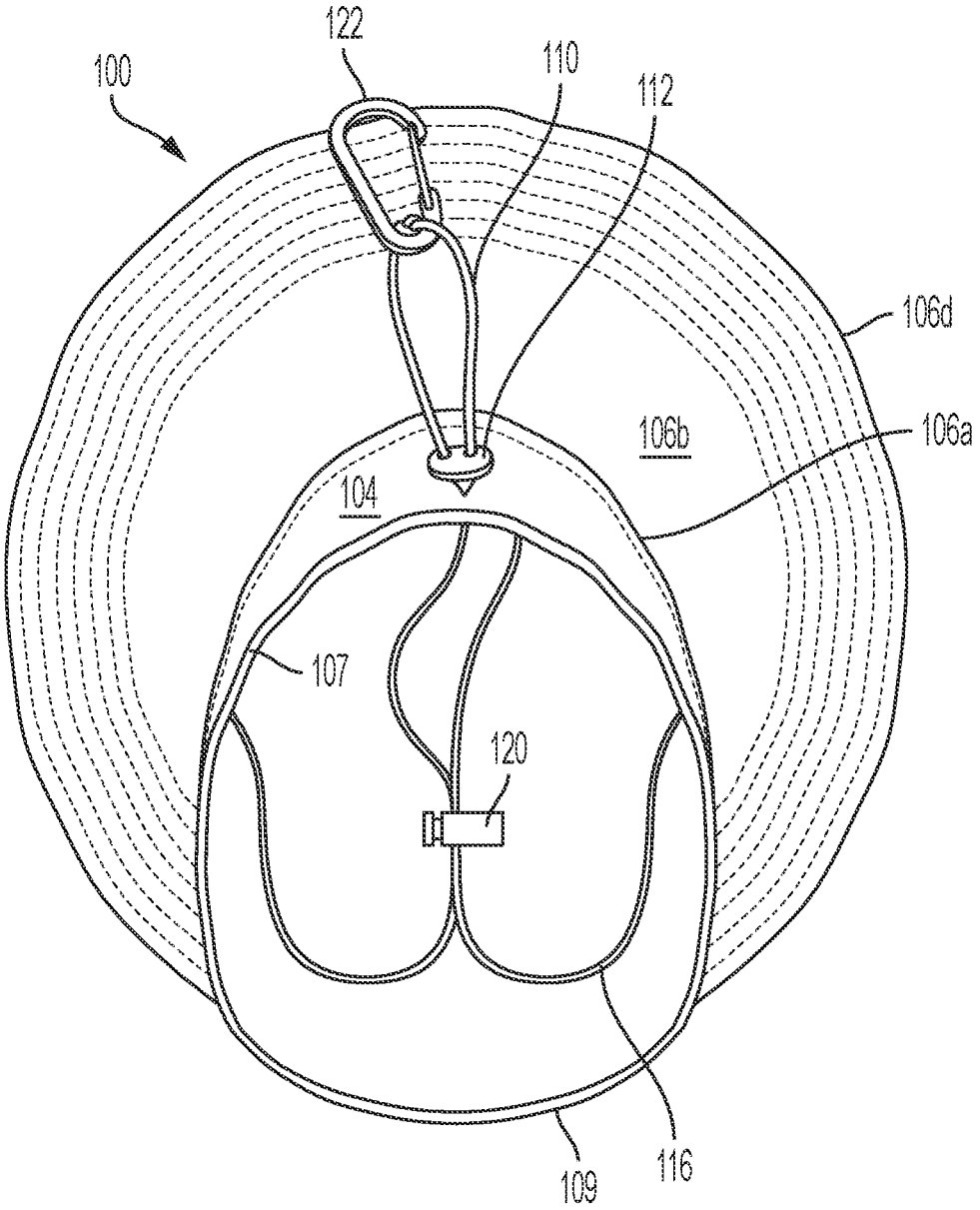
FIG. 9 is a plan view of the adjustable brim of FIG. 1 as a removed from the user and/or the baseball cap.
Figure 10:
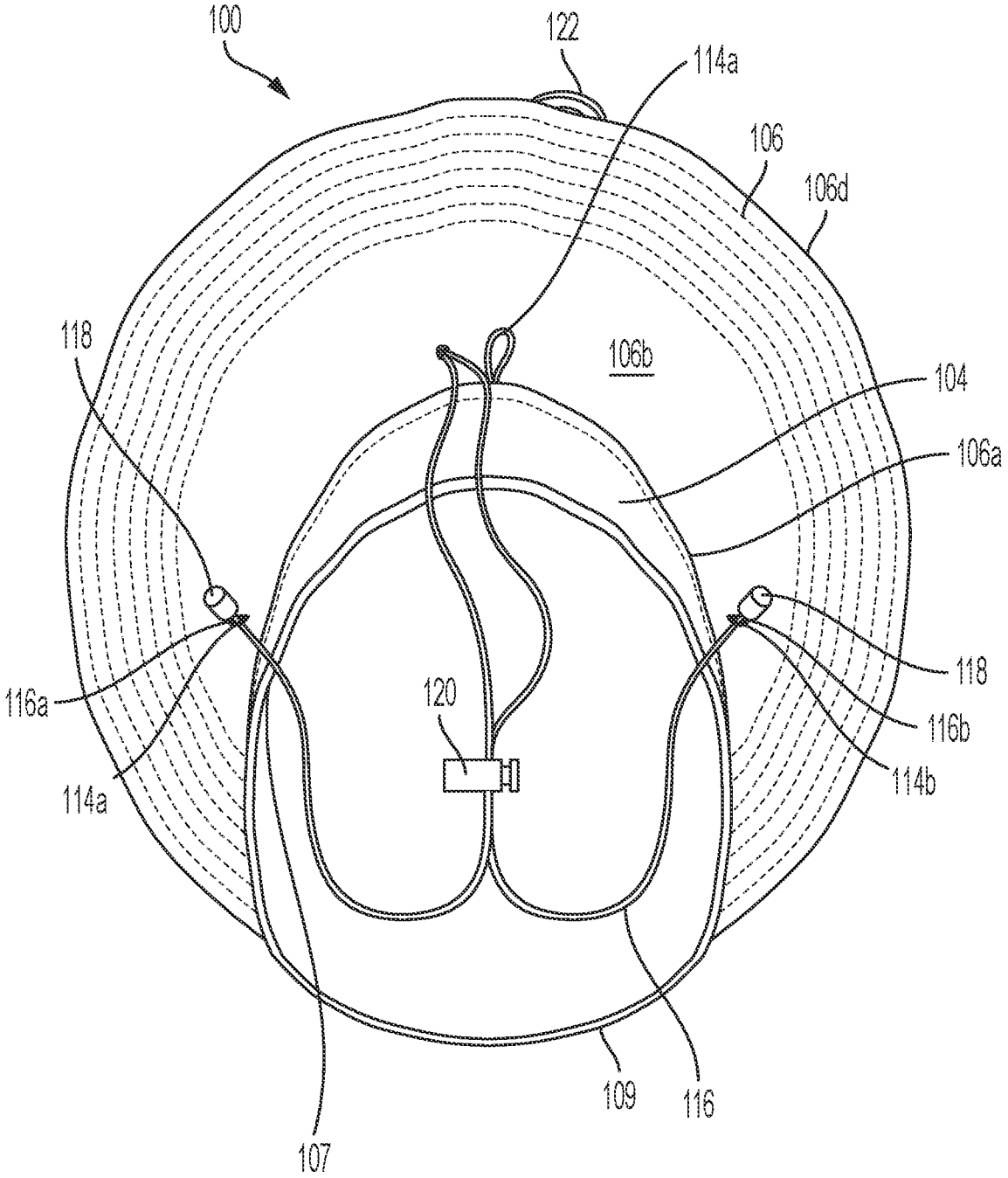
FIG. 10 is a bottom plan view of the adjustable brim of FIG. 1 as a removed from the user and/or the baseball cap.
Figure 11:
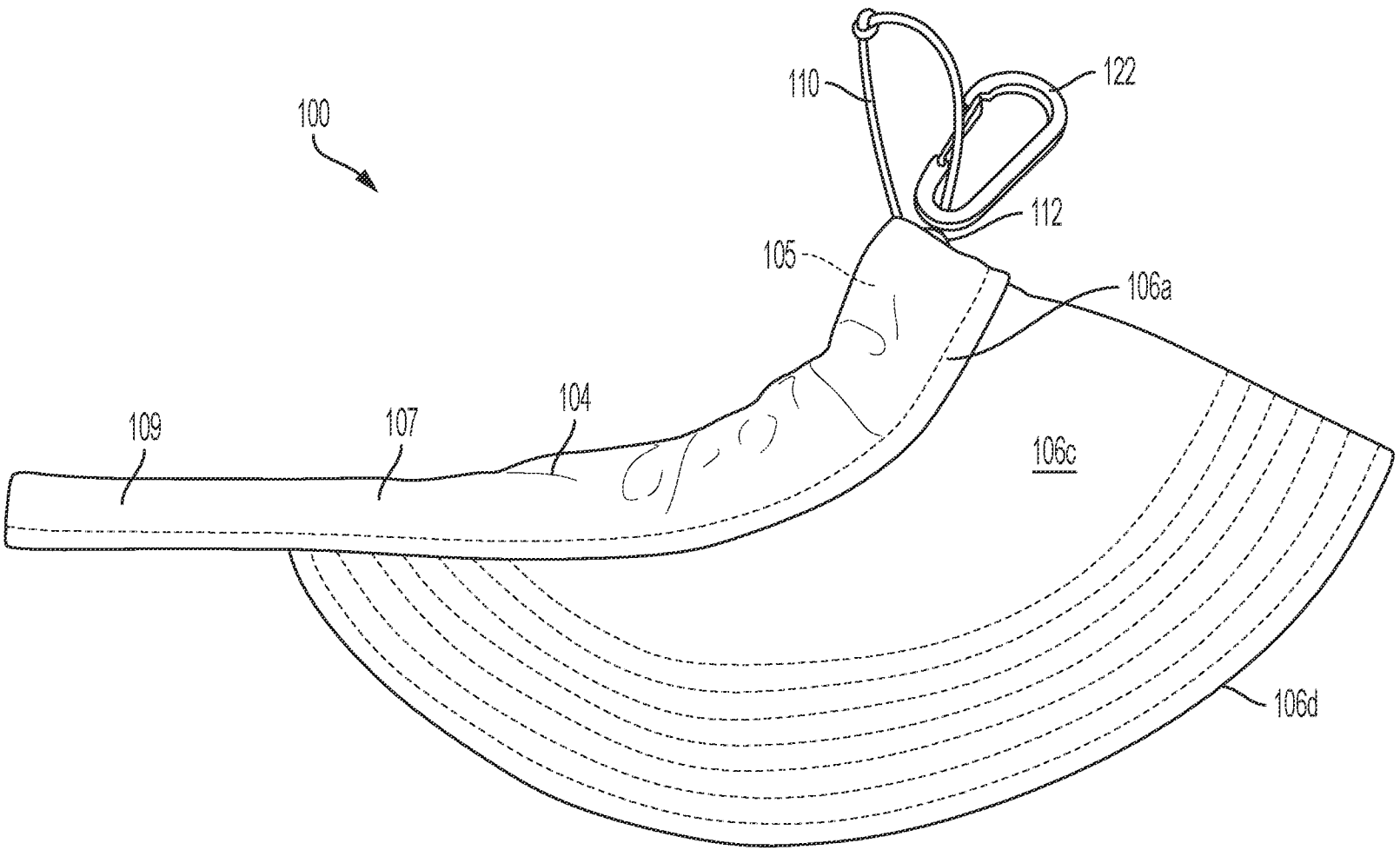
FIG. 11 is a side view of the adjustable brim of FIG. 1 as a removed from the user and/or the baseball cap.
Figure 12:
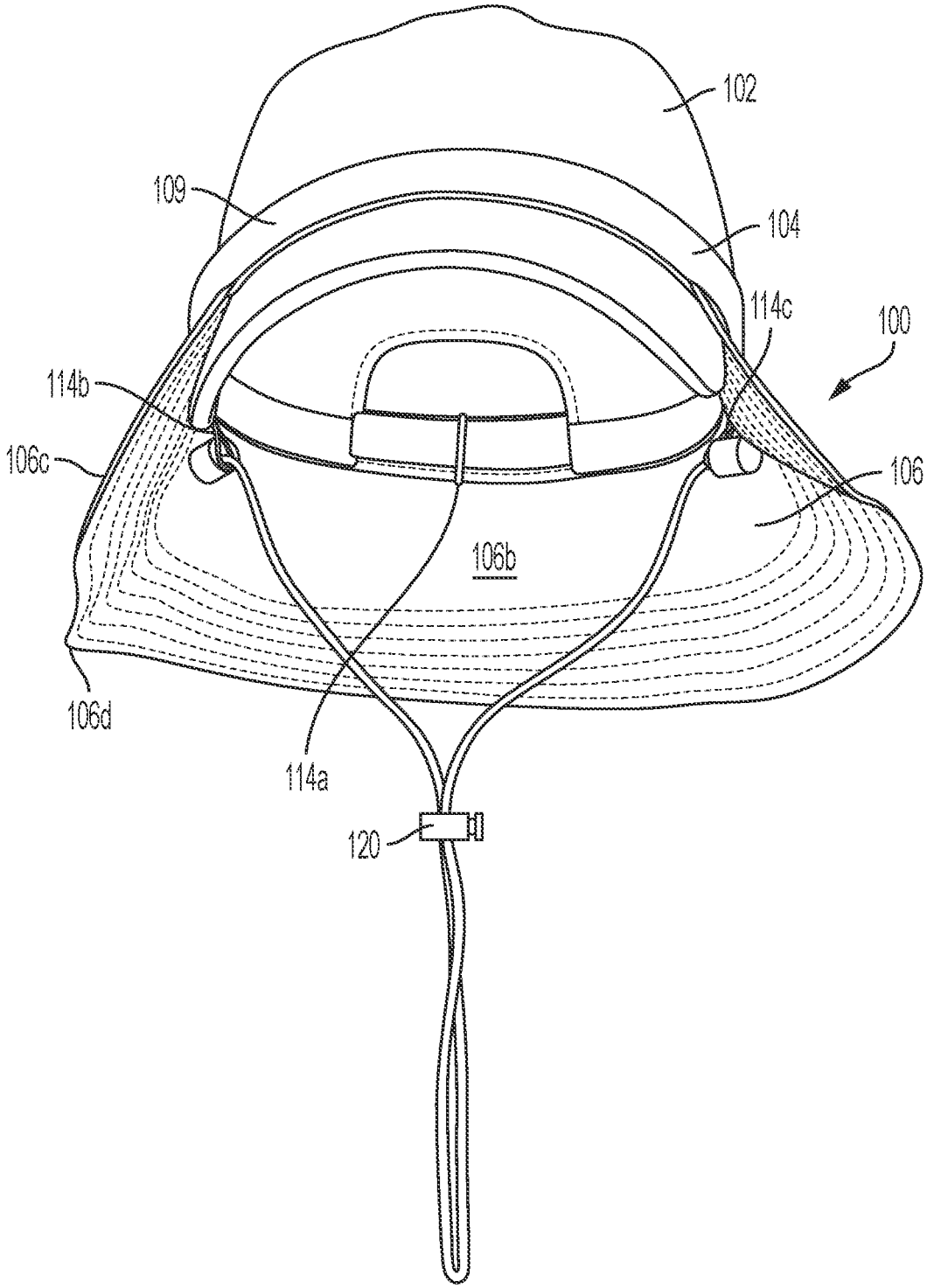
FIG. 12 is a front isometric view positioned on a hat of the adjustable brim of FIG. 1 represented as removed from the user's head.

As shown in FIG. 7, the sheath 104 includes the first portion 107 along with the inner edge of the body 106 extends and a second portion 109 that is not attached to the body 106. During use, the second portion 109 of the sheath 104 rests against the front brim 100 of the ball cap 102, as shown in FIG. 10. By providing the portion 109 of the sheath 104 that is free from the body 106, the adjustable brim 100 may be rotated, or adjusted on a rotational axis around the baseball cap or user's head, so that the user can adjust which area of the user's body receives shade and which area of the user's body receives sunlight. This is advantageous, for example, in watching sporting events or when working with the sun in a position shining into the eyes of the wearer beyond the shade provided by a standard brim-visor. Thus, in addition to using the brim-visor symmetrically placed on a cap, it can be positioned asymmetrically in an off-center position relative to the face, to screen or block direct sun when and where needed.

In some embodiments, the channel 105 (FIGS. 7 and 8) may extend within only the first portion 107 of the sheath 104 and the second portion 109 of the sheath 104 may include additional and/or different material such a fabric insert comprising relatively more resilient material. In still further embodiments, the second portion 109 of the sheath may have a narrow thickness so as to minimize interference with the logo or other information on the front of the baseball cap 102. While portability allows for a high frequency of use as mentioned above, ensuring that the logo and other information on the front of the baseball cap 102 is accommodated is also important to increase the likelihood of use. The second portion 109 conforms to the spherical shape of the user's forehead or baseball cap, which enables the adjustable brim 100 to remain in place on the user's head without slipping towards the crown of the user. In other embodiments, the body 106 may extend along the full length of the sheath 104 and overlap the brim 100 of the ball cap 102 as needed.

The tightening device 110 is positioned within the sheath 104 to allow for adjustment of the brim 100 about the user's cap 102 or head. In the embodiment illustrated in FIG. 6B, the tightening device 110 includes first and second cord portions 110*a*, 110*b*, respectively, extending from the channel 105 within the first portion 107 of the sheath 104. In one embodiment, a central portion 110*c* of the tightening device 110 includes a tubular elastic material that conforms into a flattened shape as the tubular elastic material is stretched apart across the second portion 109 of the sheath 104 (see FIG. 8) that is positioned against the baseball cap 102 during use (see FIG. 12). The central portion 110*c* extends through the sheath 104 and prevents slippage of the sheath upwardly along the convex curvature of the user's or the baseball cap's forehead region. The first and second cord portions 110*a*, 110*b* connect to form a loop at an opening 111 (see FIG. 8) of the sheath 104 at a mid-point of the first portion 107 and may connect to the central portion 110*c* through stitching, an adhesive, or any other suitable connection means. The first and second cord portions 110*a*, 110*b* may form a single length of cord or may be discrete, connected lengths of cord. In other embodiments, the tightening device 110 may be one continuous length of material or a plurality of length of material secured together. The tightening device 110 may be comprised of cloth, webbing, string, or other suitable material and may be smooth, knotted, or have any other variation in design. In still further designs, the adjustable brim 100 may be attached to a baseball cap 102 as noted above.

The fastener 112, such as a cord lock as shown in FIGS. 8-11, is positioned on and moves along the loop of the tightening device 110 to adjust the fitting of the sheath 104 about the hat 102. The fastener 112 can be adjusted up and down the loop of the exterior portion of the tightening device 110 such that the sheath 104 can be enlarged and contracted to fit various sizes of hats and/or heads. The fastener 112 may alternatively comprise a buckle, a leather slide, a knot, or other suitable mechanism.

In other embodiments, the channel 105 extends along the entire length of the sheath 104, and the tightening device 110 is positioned within the channel 105 so that first and second ends of the tightening device 110 extend from the opening in the sheath 104.

FIGS. 7 and 10 show the bottom side 106*c* of the adjustable brim 100 for a baseball-style cap 102. In the illustrated embodiment, at least three loops 114*a*, 114*b*, 114*c* are attached to the bottom surface 106*b* of the body 106 adjacent the inner edge 106*a* and sheath 104. The loops 114 may comprise an elastic material, although any suitable material may be used.

A first loop 114*a* is located on the inner edge 106*a* away from the second portion 109 of the sheath 104. As the second portion 109 of the sheath 104 sits against the front brim 100 of the ball cap 102 as shown in FIG. 2A, a back strap closure of the ball cap 102 along the back of the hat 102 may be threaded through the first loop 114*a* (FIG. 12) or looped over to secure the brim 100 to the ball cap 102. In other embodiments, the back strap closure of the ball cap 102 may be secured to the brim through hooks, snaps, Velcro®, or any other suitable means of attachment.

Referring to FIGS. 7 and 10, the second and third loops 114*b*, 114*c* are symmetrically placed along the length of the sheath 104 such that they are diametrically opposite. In an embodiment, a removable chin strap 116 is attached to the second and third loops 114*b*, 114*c* of the adjustable brim 100. Each end 116*a*, 116*b* of the chin strap 116 may include a bead 118 or other bulbous shaped object to be threaded through the second loop 114*b* and the third loop 114*c*, respectively. In alternative embodiments, bulbous shaped object may be "T"-shape, a hook, a clasp, or any such mechanism to attach the chin strap 116 to the adjustable brim 100 via the second loop 114*b* and the third loop 114*c*. By including a chin strap 116 that is removable, the user can use the chin strap 116 when convenient or needed, and can store the chin strap 116 and avoid unnecessary components when the conditions do not warrant the chin strap 116.

In other embodiments, the chin strap 116 may attach to the brim 100 through snaps, ties, or other securement means. It is also contemplated that any number of loops 114*a*, 114*b*, 114*c* or other securement means could be included. In still further embodiments, the chin strap 116 may be sewn or otherwise directly secured to the underside of the body 106 along the inner edge 106*a* adjacent to the sheath 104.

The chin strap 116 may include a chin strap fastener 120 at a midpoint along its length which enables the user to adjust the tightness of the chin strap 116 against the chin. In other embodiments, the ends 116*a*, 116*b* of the chin strap 116 connect to the adjustable brim 100 through snaps, Velcro®, or other securement means.

Figure 13:
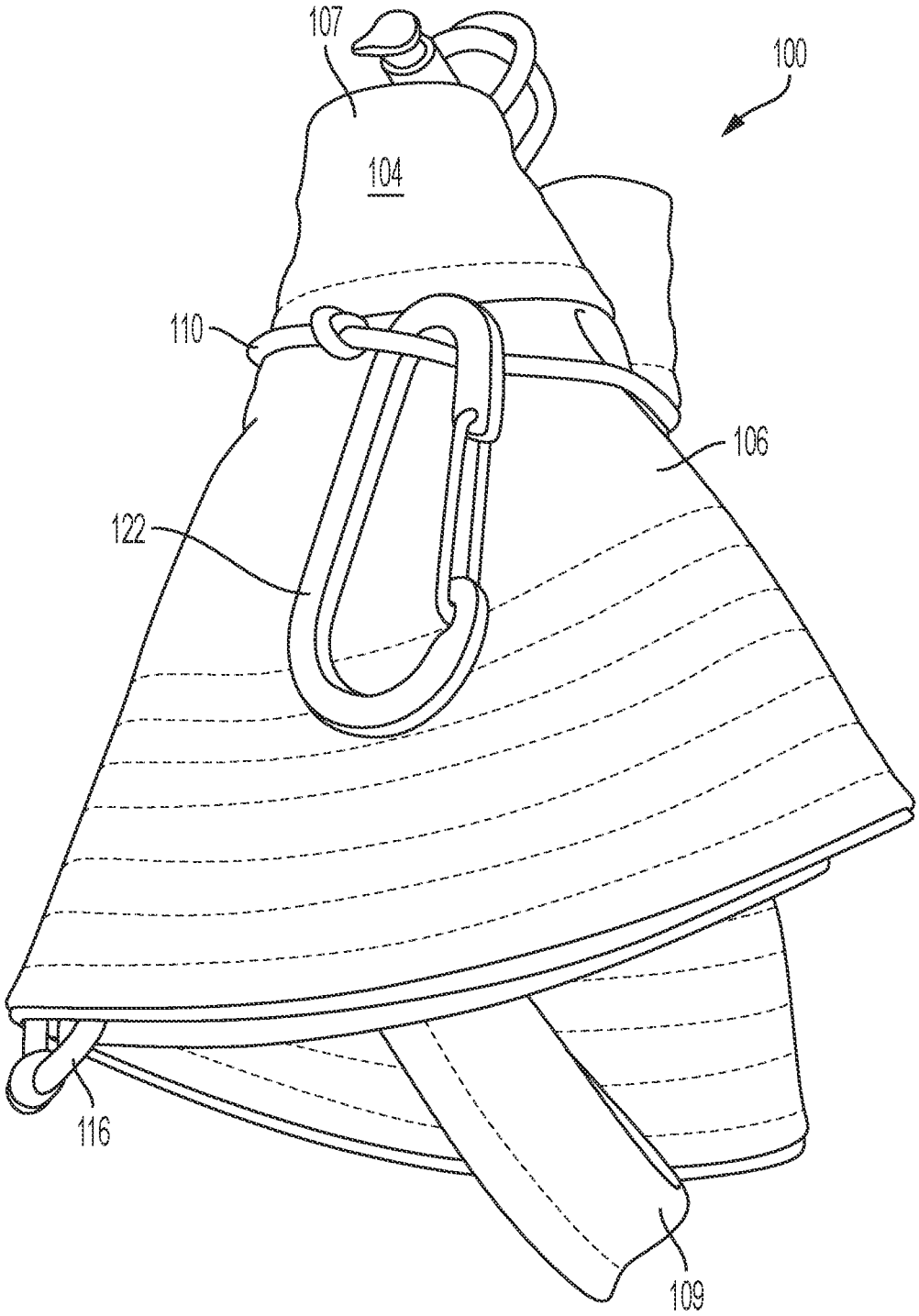
FIG. 13 is isometric view of the brim folded upon itself of the adjustable brim for a hat of FIG. 1.

FIG. 13 shows the adjustable brim 100 in a folded, compact position. The adjustable brim 100 can be folded such that a substantial part of the sheath 104 and the chin strap 116 are rolled into the center of the body of the brim 106. The tightening device 110 can be wrapped around the rolled brim body 106 and secured in that configuration by the fastener 112 to store or transport the adjustable brim 100 in a more convenient fashion.

A conventional hat includes two principal parts: the crown and the brim, while the conventional cap can consist of just a crown, although a variety of cap types include visors. The adjustable brim 100 described herein is meant to be used with both hats and caps with or without a visor or brim portion. For example, the adjustable brim 100 may be used with brimless hats and crownless visor caps when the user experiences circumstances of sun or the elements (such as rain, hail, sleet, snow or fog). While the adjustable brim 100 may be used as a sun effect mitigation strategy providing ventilated and fully adjustable shade interventions, the adjustable brim 100 can also be used to provide warmth, shed rain, blunt the wind's force, hold in body heat, and/or protect the head, face, and neck regions from the cold. In these latter situations or conditions, the adjustable brim 100 would be used to blunt the negative effects of a wide range of potentially adverse exposures when the user is exposed to sun or the elements (such as rain, hail, sleet, snow or fog). Because the adjustable brim 100 can be constructed with outer fabric of a type that can be considered camouflaged for one environment or another, the functionality may go beyond protection from the elements but as an extension of the activity in which the user, such as hunters, fishermen, warriors, etc. are participating, and which in some cases may take precedence over the environment condition being mitigated against. Being an adjustable brim, these various other uses are at the user's discretion depending on what hat, cap, or other clothing device is available at the time and on the conditions that the user wishes to address.

The adjustable brim 100 may include a carabiner 122, hook, or other means for attaching the brim 100 to a belt loop, another part of clothing, the strap of a bag, or other item.

The body 106 and the sheath 104 of the brim 100 may comprise any fabric material. In some embodiments, some or all of the brim 100 may include a waterproof material. In other embodiments, the outer surface 106*c* of the body 106 may comprise a waterproof material and the inner surface 106*b* may comprise a fleece or other soft material.

It should be noted that various changes and modifications to the presently preferred embodiments described herein will be apparent to those skilled in the art. Such changes and modifications may be made without departing from the spirit and scope of the present invention and without diminishing its attendant advantages.

The invention claimed is:

1. A brim for use with a hat, wherein the hat is configured to sit atop a head of a user, the brim comprising:

an approximately circular shaped sheath defining a channel and including a curved attachment edge;

a tightening device positioned within the channel of the sheath; and a brim body attached to the sheath, the brim body including:

an inner edge;

an outer edge opposite the inner edge;

an inner surface and an outer surface opposite the inner surface spanning the inner edge to the outer edge; and wherein the brim body is constructed of a material having sufficient rigidity to maintain a set manipulated shape;

wherein the brim body is shaped such that, if the brim body were to be laid flat along a planar surface, each of the inner edge and the outer edge would exhibit a curved shape different from the curved attachment edge; and wherein, when the sheath is positioned around the hat when worn by the user, attachment between the inner edge of the brim body and the attachment edge of the sheath supports the outer edge of the brim body in position below the attachment edge, wherein a portion of the outer edge of the brim body is configured to be maintained in a lofted position spaced above a neck and ears of the user, wherein the maintaining of the lofted position is functionally due to said sufficient rigidity of the brim body's material.

2. The brim of claim 1, wherein, if the brim body were to be laid flat along the planar surface, a majority of the inner edge and a majority of the outer edge each comprise a respective parabolic curve portion.

3. The brim of claim 2, wherein the lofted position is a first position, and wherein the outer edge of the brim body is configured to be manipulated between the lofted first position and an upward second position.

4. The brim of claim 3, wherein a first portion of the outer edge of the brim body is configured to be manipulated into the lofted first position and a second portion of the outer edge of the brim body is configured to be manipulated into the upward second position.

5. The brim of claim 2, wherein the inner edge and the outer edge of the brim body meet at outer points of the brim body.

6. The brim of claim 5, wherein the brim body has a crescent shape.

7. The brim of claim 2, wherein a connection of the parabolic curve portion of the inner edge to the circular sheath assists the portion of the outer edge of the brim body to be maintained in the lofted position spaced above the neck and ears of the user, when the brim and the hat are being worn by the user.

8. The brim of claim 1, wherein a radius of curvature of the rounded shape of the inner edge varies between outer points of the brim body.

9. The brim of claim 1, wherein the curved attachment edge of the sheath defines a plane P and the inner and outer surfaces of the brim body form an angle with the plane P of between 55 and 65 degrees.

10. The brim of claim 1, wherein the sheath includes a front sheath surface and a rear sheath surface that define the channel, wherein the front sheath surface and the rear sheath surface are connected along an upper edge and a lower edge, and wherein the lower edge comprises the attachment edge.

11. A method for using a brim with a hat, wherein the hat is configured to sit atop a head of a user above a neck and ears of the user, the method comprising:

providing the brim, the brim comprising:

an approximately circular shaped sheath defining a channel and including a curved attachment edge;

a tightening device positioned within the channel of the sheath; and a brim body attached to the sheath, the brim body including:

an inner edge;

an outer edge opposite the inner edge; and an inner surface and an outer surface opposite the inner surface spanning the inner edge to the outer edge;

wherein the brim body is constructed of a material having sufficient rigidity to maintain a set manipulated shape;

wherein the brim body is shaped such that, if the brim body were to be laid flat along a planar surface, the inner edge would exhibit a curved shape different from the curved attachment edge; and positioning the sheath of the brim about a base of the hat so that the outer edge of the brim body is below the attachment edge, wherein a portion of the outer edge of the brim body is configured to be maintained in a lofted position spaced above the neck and ears of the user, when the hat sits on the user's head, and wherein the maintaining of the lofted position is functionally due to said sufficient rigidity of the brim body's material.

12. The method of claim 11, wherein the curved attachment edge of the sheath defines a plane, and wherein the inner and outer surfaces of the brim body form an angle with the plane of between 55 and 65 degrees.

13. The method of claim 11, wherein the positioning step comprises positioning the sheath of the brim about the base of the hat so that the outer edge of the brim body is in a downward position below the attachment edge and spaced from above the neck and ears of the user, and further comprising a step of manipulating a further portion of the outer edge of the brim body into an upward position.

* * * * *